United States Patent [19]

Capdevila et al.

[11] 4,135,695

[45] Jan. 23, 1979

[54] MOLDING MACHINE MORE PARTICULARLY FOR THE MANUFACTURE OF SQUARE-SHAPED CONSTRUCTION ELEMENTS

[76] Inventors: Claudio Capdevila, Calle Ramon Albo, 72-74, esclo. izquierda, 1 3a, Barcelona 16, Spain; François A. Juan, 52, rue Yves Farges, Grigny (Rhône), France; Gaëtan Venditti, 10, rue Fréres Benoit, Oullins (Rhône), France; Michel E. L. Alquier, 10, rue Meyer, Mazamet (Tarn), France

[21] Appl. No.: 775,529

[22] Filed: Mar. 8, 1977

[30] Foreign Application Priority Data

Mar. 8, 1976 [FR] France ..... 76 07399

[51] Int. Cl.[2] ..... B28B 7/26

[52] U.S. Cl. ..... 249/118; 249/129; 249/137; 249/161; 249/172; 425/218

[58] Field of Search ..... 249/129, 161, 118, 172, 249/120, 119, 137; 425/218

[56] References Cited

U.S. PATENT DOCUMENTS

| | | | |
|---|---|---|---|
| 787,375 | 4/1905 | Gatteridge | 249/172 |
| 969,410 | 9/1910 | Scheiker | 425/218 |
| 3,220,692 | 11/1965 | Eklund | 249/161 |
| 3,400,670 | 9/1968 | Pakula | 425/218 X |
| 3,488,817 | 1/1970 | Katz | 249/160 X |
| 3,578,276 | 5/1971 | Soderlund | 249/137 X |
| 3,628,766 | 12/1971 | Hartmann | 249/129 |
| 3,881,856 | 5/1975 | Fougea | 249/129 X |
| 3,892,516 | 7/1975 | McGrew et al. | 249/129 X |

*Primary Examiner*—W. R. Briggs
*Attorney, Agent, or Firm*—Karl F. Ross

[57] ABSTRACT

A molding machine for the production of polygonal structural elements, e.g. concrete squares, comprises an assembly of vertical plates disposed between a pair of end members of a support and defining generally flat mold cavities of the shape desired with respective bottom members and lateral gates. The lateral gates are hinged to the rectangular bottom members at the ends thereof and are interconnected by respective bars so that all of the lateral gates along each side of molded cavities can be swung outward into release position and indeed into mold-closing positions by laterally shiftable carriers on the end members of the support.

9 Claims, 6 Drawing Figures

MOLDING MACHINE MORE PARTICULARLY FOR THE MANUFACTURE OF SQUARE-SHAPED CONSTRUCTION ELEMENTS

FIELD OF THE INVENTION

The present invention relates to a molding machine and more particularly to a machine for the manufacture of square-shaped construction elements.

BACKGROUND OF THE INVENTION

At the present, for the manufacture of construction elements of this type, whether they be or plaster of cement, individual molds are used with articulated walls permitting the removal of the squares from the mold. Dual molds are also known. These single or dual molds permit neither a high production rate nor an accelerated automation cycle of manufacture.

There are also known multiple-mold machines in which the stripping conditions are not positively controlled so as not only to prevent mechanized or automated handling after stripping but also to make a considerable percentage of waste inevitable.

Moreover these molds cannot be closed with proper tightness difficulties encountered on closure inevitably slow down production considerably.

OBJECT OF THE INVENTION

The present invention aims to overcome this disadvantage.

SUMMARY OF THE INVENTION

The machine of the invention comprises slidable mountings on at least one horizontal beam of a structure, a series of vertical rectangular plates, each of which constitutes a common lateral vertical wall of two adjacent molds and with each of which is associated a first horizontal rectangular plate constituting the bottom of the mold whose width corresponds to the thickness of an element to be molded, and two other rectangular plates of the same width as the first, of a length corresponding to the height of the vertical plates. Means is provided for, maintaining the vertical plates in molding position with the edge of the bottom plate of a mold left free and with lateral gates associated therewith and which in the closure position resting against the external face of the vertical plate of the adjacent mold. This means also increases the spacing of the vertical plates up to a molding position, while other means are provided for maintaining the lateral gates in the closure position during the molding and to make them swing into the opening position when during stripping.

In this machine each horizontal rectangular plate constituting the bottom of a mold is integral with one of the two vertical plates constituting the vertical walls of this mold and each lateral gate of a mold is articulated to one of the two opposite extremities of the horizontal rectangular plate constituting the bottom of this mold. One thereby obtains a multiple-mold machine with a high production rates.

In cases where construction elements have to contain tenons and mortises for assembly, the inner faces of the bottom plates and of the lateral gates of the molds represent complementary profiles of these tenons and mortises and the machine comprises, furthermore, a scraper which permits to trace in the upper section of the square, prior to stripping, the profile of a tenon or mortise desired.

In this case, advantageously, there is provided at the forward end of the scraper stroke a receptacle for the recovery of material torn away by the scraper.

According to an embodiment of the invention, the means for displacing the vertical plates from their molding position into their stripping position and vice versa comprise, on the one hand, a jack disposed on one of the sides of the structure, with its axis parallel to that of the beam serving as a guide for the plates, and whose shaft is tied axially to the first vertical plate, that is to say that which is situated nearest to the jack, and, on the other hand, flexible links such as chains or cables connecting each plate of a mold to that of the adjacent mold and whose length corresponds to the maximum spacing of the plates, the other outermost plate being immobilized with reference to the structure.

Advantageously, these flexible links are provided between the bottom plates of the molds.

Preferably, the means for maintaining the lateral gates in closure position and letting them swing into opening position, and vice versa, comprises, for each series of gates situated on the same side, a horizontal bar traversing grooves each of which is integral with a gate, means being provided for transverse displacement of this bar along an arc of a circle corresponding to the course of the groove during the operations of the opening and closing the gates.

According to a feature of the invention, the means for transverse displacement of the control bars for the opening and closing of the gates comprises, at each extremity of said bar, a carriage mounted on a horizontal leadscrew whose axis is orthogonal to that of the articulation of the gates which presents a vertical gap in which is lodged the extremity of the bar here considered.

To insure a correct opening of the molds, according to another feature of the invention, flexible links are also provided between the free extremities of the lateral gates.

According to yet another advantageous feature of the invention, the structure of this machine is mounted pivotally about a horizontal axle supported by fixed bearings.

This arrangement allows the removal of the squares from the mold by gravity. For this it is sufficient to slide, after having brought the plates and the gates into stripping position, a manipulation tray between one of the series of lateral gates and the corresponding edges of the plates and to make the structure tilt to the side where this tray has been inserted while maintaining the latter leaning against the aforementioned edges of the plates. The squares fall by gravity onto the tray which needs only to be retracted horizontally to release the machine.

Preferably, the machine is provided on one of the sides of the vertical plates with engagement means for the attachment of a manipulation tray.

Finally, according to still another feature of the invention, a feeding hopper for the molds is provided. This hopper is preferably of the rocking type.

In the embodiment previously described, after total opening of the molds, each square resting on the bottom plate of its mold remains in contact with the vertical plate integral with said bottom and the tilting of the molds, after the emplacement of a manipulation tray, must normally induce the dropping of the squares onto this tray. One may, however, fear that the adherence of a square to a vertical plate could suffice to resist the weight of said square and impede its detachment from said plate; to remedy this, in accordance with an advantageous feature of the invention, the vertical plates are interconnected at the level of their upper edges by flexible links similar to those connecting the bottom plates of the molds and the free extremities of the lateral gates, the length of the flexible link from the next-to-last vertical plate to the last one, which is fixed, being slightly longer than the other links connecting the bottom plates and the lateral gates of the two molds corresponding to these two vertical plates.

Consequently, at the end of the opening of the molds, there occurs an instant when all the flexible links are stretched except the one connecting the last plates. As a result in prolonging the advance of the jack until the stretching of this last flexible link, all the vertical plates except for the last, fixed one will be slanted toward the jack and thereby detached from the squares which themselves are maintained vertical by the lateral gates.

To permit a control of the inclination of the vertical plates at the end of the opening of the molds, at least one of the extremities of the last flexible link is fastened to a length-adjusting means such as a micrometric screw.

Advantageously, the flexible links between the upper edges of the vertical plates are situated in proximity to an angle, which facilitates their deflection.

BRIEF DESCRIPTION OF THE DRAWING

The invention will be most fully understood with the aid of the following description, reference being made to the schematic drawing attached, representing embodiments of a molding machine according to the invention.

In the Drawing

SPECIFIC DESCRIPTION

Figure 1:
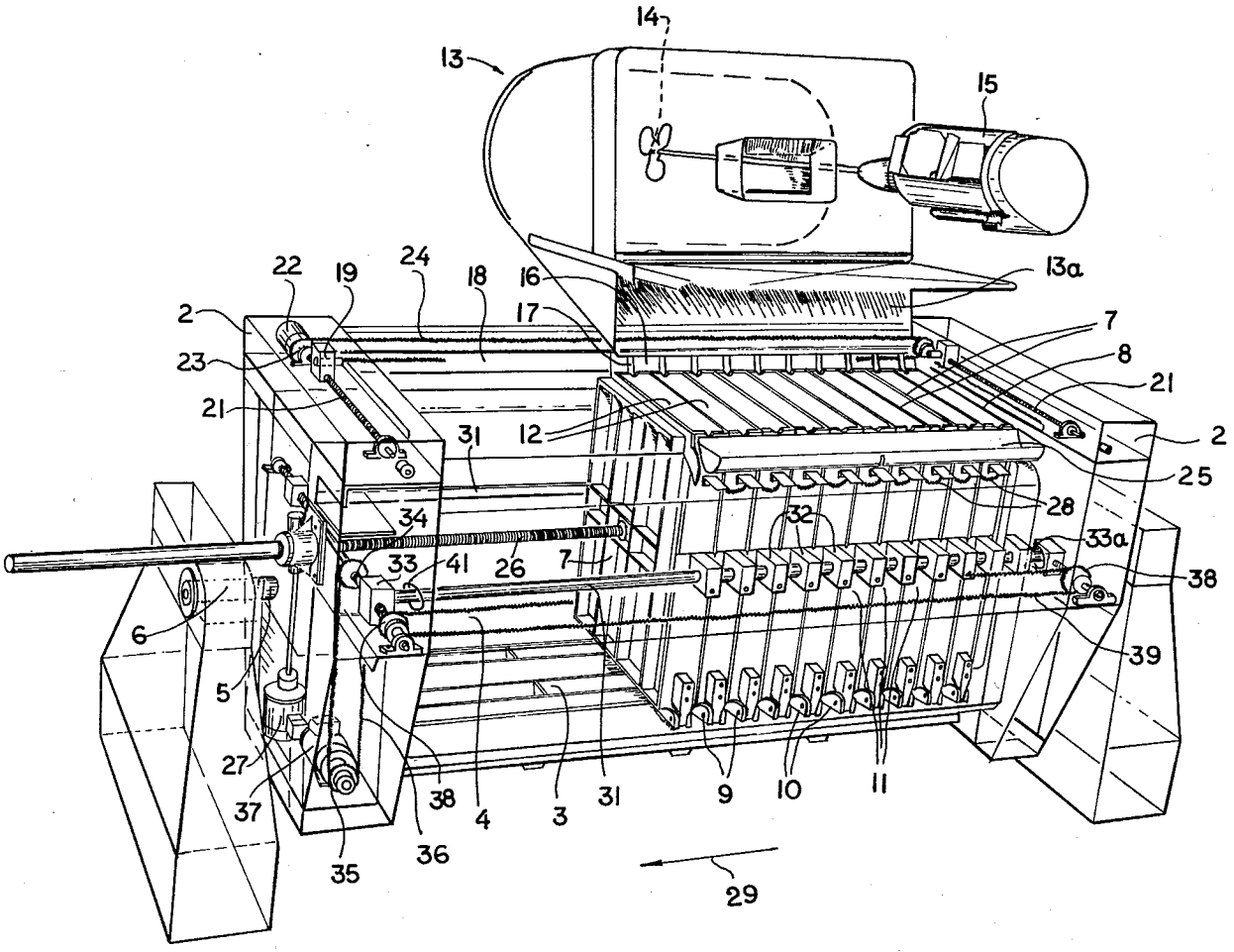
FIG. 1 is a perspective view of the molds in their filling position.

The structure of this machine is composed of two upright casings 2 interconnected by a lower horizontal beam 3 and two horizontal cross-bars 4. The casings 2 contain the elements controlling the various movements required for the functioning of the machine and which are explained in detail hereinafter.

Each casing 2 further carries on its face opposite the one confronting the other casing 2, a pivot 5 with a horizontal axis supported by a stationary bearing 6. The two pivots 5 allow the tilting of the two casings 2 and all the components they carry around their common horizontal axis. The horizontal beam 3 serves as a guide to the movable compartments of the molds of this machine. To this effect, a plurality (ten in this example) of vertical plates 7 are slidably mounted on the lower beam 3 while a supplemental plate 8, the one situated at the extreme right on the drawing, is immobilized with regard to the structure of the machine.

With each of the movable plates 7 there is associated an elongated horizontal plate 10 secured perpendicularly by one of its long edges to the horizontal bottom; edge of the plate 7 so as to constitute the bottom of a mold cavity. On each of the two opposite short edges of each of these elongated bottom plates 10 is mounted a horizontal hinge 9 parallel to the longitudinal axis of the beam 3 and on which is articulated a gate 11 constituting one of the two narrow lateral walls facing a mold cavity. Of course, the second broad vertical wall of each cavity is constituted by the outer face of the vertical plate 7 of the adjacent mold cavity. One thereby obtains, with the ten movable plates 7 and the stationary eleventh plate 8, ten mold cavities 12 whose profiles are of the form of flattened parallelepipedic rectangles corresponding to that of the construction elements desired to be molded in the shape of squares. Since these elements are destined to be stacked on their edges in order to form walls or partitions, they are generally provided with a tenon on two of their adjacent edges and with a mortise on the two other edges. To this effect, the inner face of the lateral gates 11 and the upper face of the bottom plates 10 present, as a projection or as a recess, the profile of a tenon or of a mortise that one desires to see appear in the corresponding edge of the construction element formed.

As is apparent from the drawing, the mold cavities are not equipped with lids and are therefore accessible by their upper face to permit their filling with the desired moldable material such as plaster or concrete. To this effect, one can advantageously provide a tilting hopper 13 possibly equipped with a mixer 14 driven by a motor 15. The width of the pouring aperture **13*a* of this hopper 13 must preferably correspond to the length of the multiple molds constituted by the totality of the vertical plates 7 and 8**.

To enable the formation of a tenon or of a mortise in the upper edge of the squares molded in the cavities 12 automatically, the machine comprises a scraper 16 having as many fingers 17 as there are cavities 12 and whose profile corresponds to that of the tenon or mortise on wishes to trace. In the example illustrated on the drawing, the fingers 17 of the scraper 16 permit production of a mortise in the upper edge of each molded square. This scraper is carried by a beam 18 parallel to beam 3, itself supported at each of its extremities by a carriage 19 mounted on a leadscrew with a horizontal axis orthogonal to that of the beam 18 and rotatingly entrained by a motor 22. The synchronization of the leadscrews 21 is assured by two pinions 23 and an endless chain 24. The pinions 23, the carriage 19, the leadscrew 21 as well as the motor 22 are located in the casings 2.

To permit the formation of mortises on the entire length of the upper edge of the molded squares, the upper edges of the lateral gates 11 are formed with a notch corresponding to the profile of the a notch of the profile of said mortise and in alignment therewith.

Finally, to permit retrieval of the material removed by the scraper 16, a recovery vessel 25 is provided directly below the upper edge of the lateral gates 11 outside of the cavities 12 and on the side of the end of the forward stroke of the scraper 16.

FIG. 1 shows the machine with mold cavities in closure position, that is to say with the free edge (the right one) of each lateral gate 11 and of each bottom plate 10 resting against the outer face of the vertical plate 7 of the adjacent mold cavity.

Figure 2:
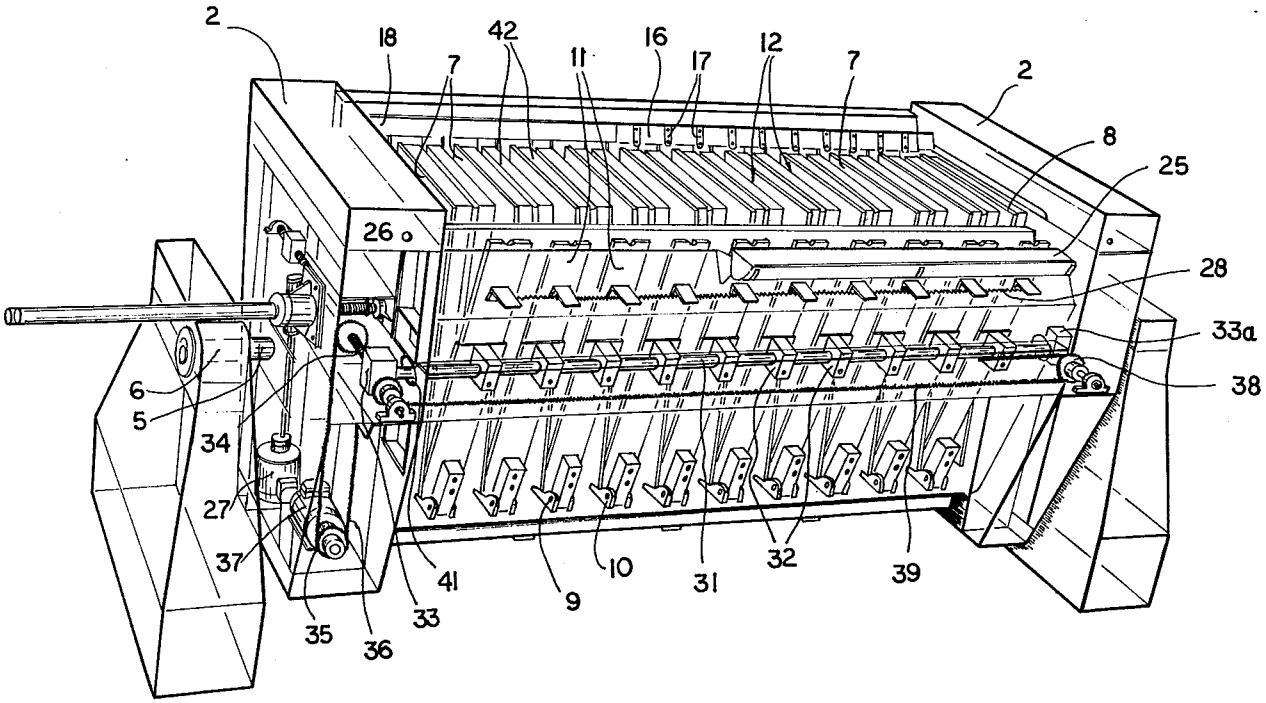
FIG. 2 is a perspective view during discharge.

To permit the removal of the squares from the mold it is therefore necessary to space the plates 7 and 8 apart from each other and to let the lateral gates 11 tilt into the opening position as represented in FIG. 2.

To this effect, the first plate 7, that is to say, the one situated at the left on the drawing, is axially connected to the extremity of the shaft 26 of a screw-jack whose rotary entrainment is controlled by a motor 27 located in one of the casings 2 (the one on the left in the drawing). Besides, each vertical plate 7 is connected to its neighbor by flexible links such as a chain 28, the last plate 7 being connected to the stationary plate 8 by the same kind of link. In the example illustrated in the drawing, three chains 28 are provided between each pair of plates 7 or 8 and its neighbor. The length of each chain 28 corresponds to the maximum spacing of two adjacent plates 7 or 8.

One can easily perceive that by the manipulation of the screw-jack 26 one can displace the first plate 7 in the direction of the arrow 29 (FIG. 1) until it reaches the position shown in FIG. 2 carrying along successively each of the other plates 7 until all the chains 28 are stretched.

To control the opening of the lateral gates 11, there is provided in combination with each series of gates 11, situated on one of the sides of the machine, a horizontal bar 31 traversing the flanges 32, each one integral with a gate 11.

At each of its extremities, each bar 31 is engaged in a vertical slot 33*a* of a carriage 33 mounted on a horizontal leadscrew 34 which has an axis perpendicular to the longitudinal axis of the beam 3 and is entrained through the intermediary of pinion 35 and chain 36, by a motor 37. The synchronization between the two carriages 33 can be assured by two pinions 38 and a chain 39. Each set of pinions 35 and chains 36 as well as one of the pinions 38 and the motor 37 are located in one of the casings 2.

One easily perceives that the horizontal displacement of the carriages 33 involves a transverse displacement of each bar 31 following an arc of a circle having as its center the hinge axis 9 of the lateral gates 11 which move along an arc of a circle resulting from the combination of the horizontal displacement of the carriages 33 and of the vertical displacement of bars 31 in the slot 33*a* of the carriages 33. A better guiding of the bars 31 can be obtained by forming in the respective wall of each casing 2 a circularly arcuate slot 41 corresponding to the exact course of the bar 31.

The opening of the mold cavities 12 being thus obtained, it is still necessary to remove the squares 42 contained therein. This removal can easily be carried out by inserting between the mold cavities 12 and the lateral gates 11, situated on the side where the squares 42 are to be extracted, a manipulation tray 43 which can be maintained against the corresponding edge of the vertical plates 7 and 8 by the engagement of bores 44, with which it is provided, with pins 45 one of which is integral with the first vertical plate 7 and the other of which is integral with the plate 8 constituting the opposite extremity of the assembly of the mold cavities.

Figure 3:
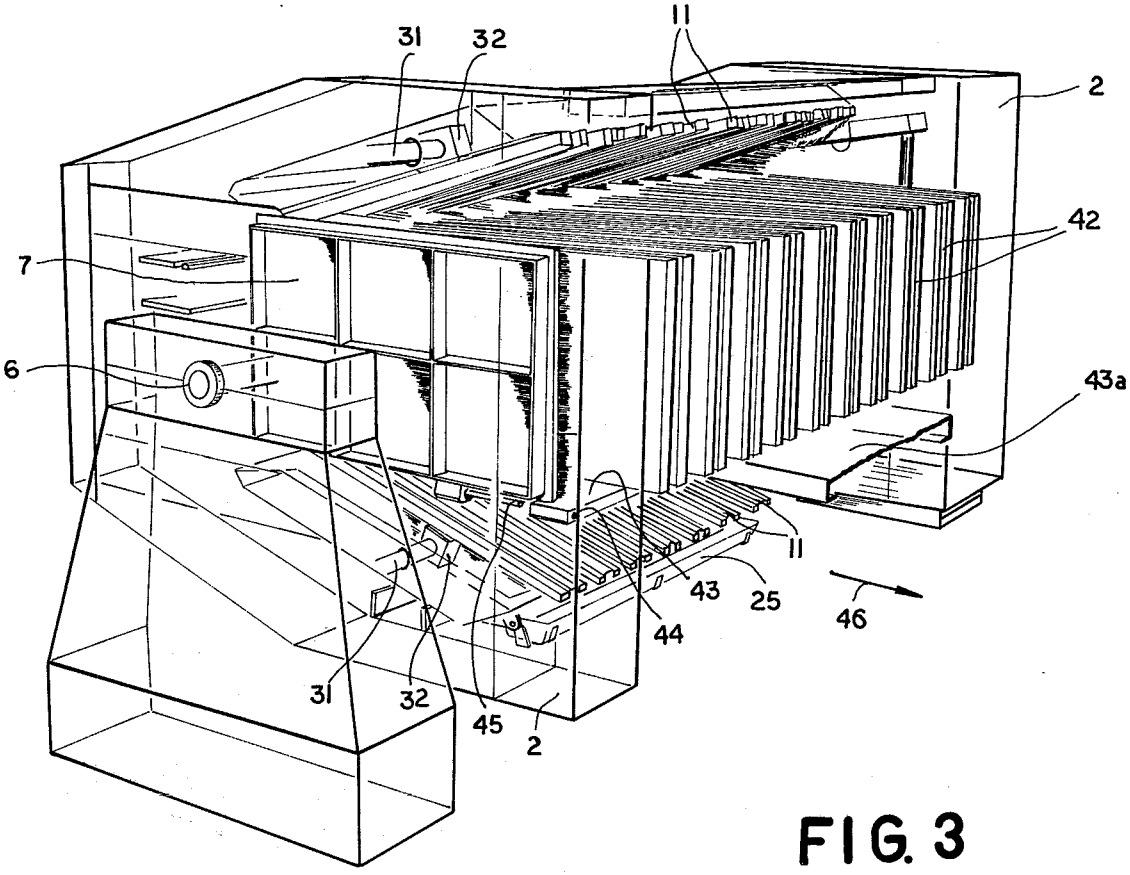
FIG. 3 is still another perspective view of the end of the discharge.

After insertion of this manipulation tray 43, one need only tilt the assembly sustained by the two casings 2 through 90° until it reaches the position shown in FIG. 3 and in which the manipulation tray 43 occupies a horizontal position. In this position, the squares drop from the mold simply by gravity and then rest on the tray 43 by their major edge, which is naturally the one provided with a mortise, thereby affording a good stability. It is then possible to retract horizontally in the direction of arrow 46, the tray 43 which is advantageously provided with an extension 43*a* allowing its seizure by, for example, the prongs of a fork lifter of the conventional type.

It can be easily understood that this machine allows the production not only of squares of a predetermined size but also of squares of another dimension because it is extremely easy to withdraw the assembly of the mold-cavity partitions of a certain size and to replace them by a set corresponding to another size of squares which may differ therefrom in length and/or thickness of the squares.

Figure 4:
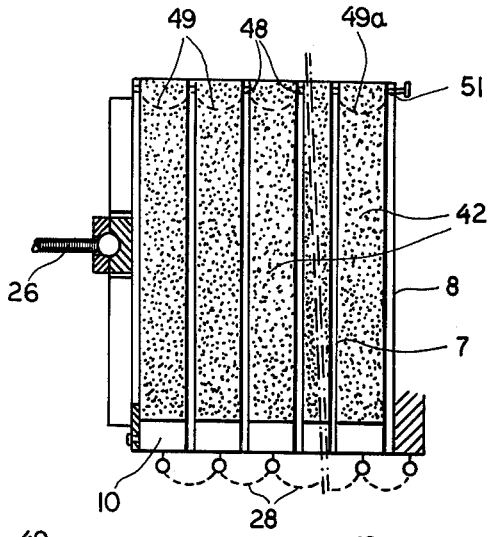
FIGS. 4, 5 and 6 are views in vertical axial section illustrating an improved form of execution of the machine according to the invention in its positions of closure near-total opening and total opening respectively.
Figure 5:
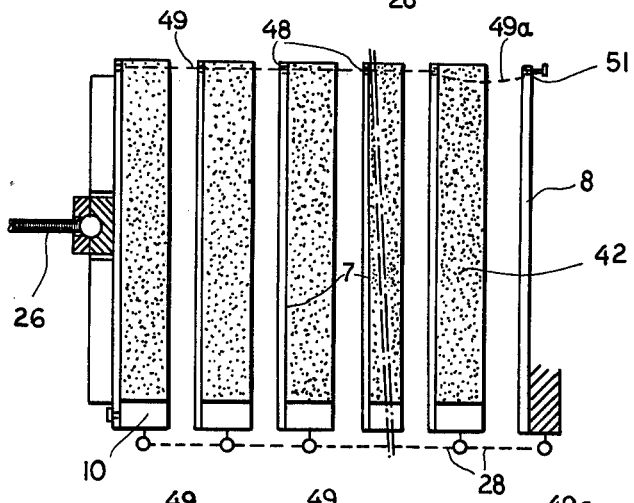
Figure 6:
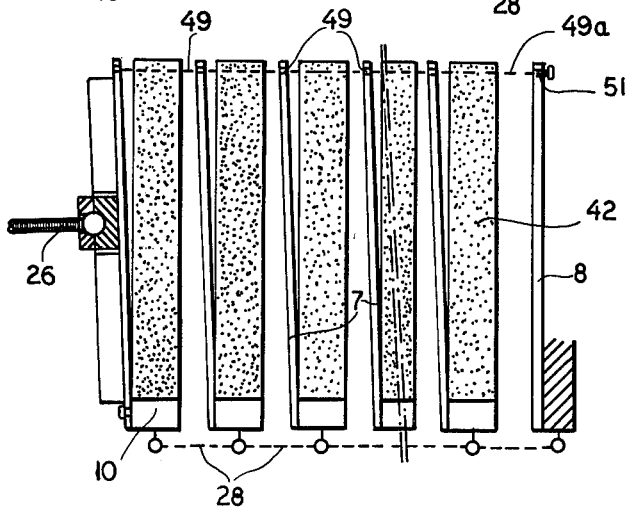

FIGS. 4, 5 and 6 illustrate an improved modification of this machine.

In this form of execution, each vertical plate 7 and 8 is provided, in proximity to its upper edge, with a lug 48.

All lugs 48 of the vertical plates 7 are connected by a flexible link, such as a chain 49, of the same length as the aforementioned flexible links 28, three of which are disposed between each vertical plate 7, that is to say, between the horizontal plates 10 constituting the bottom of the mold and the upper free extremities of the lateral gates 11.

According to this improvement, the chain 49*a* connecting the last vertical mobile plate 7 to the vertical plate 8 integral with the structure has a length slightly greater than that of the chains 49 and 28. As a result, at the end of the normal opening of all the molds as illustrated in FIG. 5, all of the chains 28 and 49 are still stretched while chain 49*a* is not.

One easily perceives that following the opening stroke of the shaft 26 of the jack, the spacing of the base of the vertical plates 7 and 8 will not be changed since chains 28, connecting the bottom plates 10, will oppose it, the squares 42 remaining also vertical since they rest on the bottom plates 10 and are maintained by the lateral gates 11 still in closure position. By contrast, the tension transmitted by all the chains 49 will provoke the stretching of the chain 49*a* which will cause the deflection of all the vertical plates 7 which thereby will be detached from the squares 42 as illustrated in FIG. 6.

One thereby obtains the assurance that the squares will fall onto the tray 43 upon the tilting of the framework of the machine.

Advantageously, the chain 49*a* is fastened to the vertical plate 8 through the intermediary of a micrometric screw 51 which permits an adjustment of its length.

The lateral gates 11 opposite the ones situated on the side of the discharge of the squares 42, that is to say, the gates corresponding to the major edges of the squares provided with a tenon, can be replaced without any inconvenience by fixed, non-articulated partitions.

In the same manner the inner faces of each cavity can exhibit in relief or as a depression any shape desired.

We claim:

1. A molding machine for the production of polygonal structural elements, comprising:

a support having a pair of mutually spaced end members;

a pair of elongated mutually parallel rectangular horizontal bottom plates disposed between said end members each adapted to define the bottom of a respective mold cavity having the configuration of the structural elements, said bottom plates having ends along narrow sides of the respective rectangles;

respective rectangular vertical plates disposed between said end members and defining opposite walls of adjacent mold cavities, one of said vertical plates serving as a common member separating said mold cavities from one another;

jack means on one of said end members and connected to the vertical plate proximal thereto for displacing said vertical plates relative to said members from a molding position, wherein the vertical plates of each mold cavity are spaced apart by a distance corresponding to the width of the respective bottom plate into a release position in which elements molded in said cavities can be discharged, said vertical plates having increased spacing from one another in said release position;

means for connecting one of the vertical plates of each mold cavity to the respective bottom plate thereof;

respective lateral gates hingedly connected to each of said ends of each of said bottom plates and swingable between closed positions wherein said lateral gates are spread away from edges of the element formed in the respective mold cavity;

shiftable respective bars extending between said members and connected to the lateral gates of the mold cavities; and means on said end members for shifting said bars to displace said gates between said mold position and said release position, and each of said bars being guided in said end members by respective grooves for arcuate movement.

2. The machine defined in claim 1, further comprising a respective carriage mounted at each end of each bar and horizontally guided in the respective end member, each bar being vertically shiftable in the respective carriage, and a leadscrew on each end member connected with the respective carriage for displacing same.

3. The machine defined in claim 1, further comprising flexible links connecting said vertical plates together at edges thereof opposite those along which said bottom plates are provided.

4. The machine defined in claim 1 wherein said elements are formed along their edges with complementary tenons and mortises constituting formations for interconnecting said elements, the inner faces of said bottom plates of the lateral gates of each mold cavity being provided with shaping means complementary to said formations for producing corresponding formation profiles on the respective edges of the element, and a scraper shiftable along the top of each mold cavity for shaping a corresponding formation along the upper edge of a respective element therein.

5. The machine defined in claim 4 wherein said scrapers are displaceable across said mold cavities from one side to an opposite side, said machine further comprising means on said opposite side for collecting material of each element scraped away by the respective scraper.

6. The machine defined in claim 1, further comprising means for rotating said mold cavities about a horizontal axis relative to said end members.

7. The machine defined in claim 6, further comprising a manipulation tray insertable between said lateral gates and said elements and adapted to receive said elements from said mold cavities.

8. A molding machine for the production of polygonal structural elements, comprising:

a support having a pair of mutually spaced end members;

a pair of elongated mutually parallel rectangular horizontal bottom plates disposed between said end members each adapted to define the bottom of a respective mold cavity having the configuration of the structural elements, said bottom plates having ends along narrow sides of the respective rectangles;

respective rectangular vertical plates disposed betwen said end members and defining opposite walls of adjacent mold cavities, one of said vertical plates serving as a common member separating said mold cavities from one another;

jack means on one of said end members and connected to the vertical plate proximal thereto for displacing said vertical plates relative to said members from a molding position, wherein the vertical plates of each mold cavity are spaced apart by a distance corresponding to the width of the respective bottom plate into a release position in which elements molded in said cavities can be discharged, said vertical plates having increased spacing from one another in said release position;

means for connecting one of the vertical plates of each mold cavity to the respective bottom plate thereof;

respective lateral gates hingedly connected to each of said ends of each of said bottom plates and swingable between closed positions wherein said lateral gates are spread away from edges of the element formed in the respective mold cavity;

shiftable respective bars extending between said members and connected to the lateral gates of the mold cavities;

means on said end members for shifting said bars to displace said gates between said mold position and said release position; and flexible links of relatively short lengths interconnecting said bottom plates and other flexible links connecting said vertical plates remote from said bottom plates, at least one of the flexible links connecting said vertical plates having a length greater than that of the flexible links connecting said bottom plates.

9. The machine defined in claim 8, further comprising a micrometric screw connected to at least one of said links for adjusting same.

* * * * *